US005945636A

United States Patent [19]

Sakich et al.

[11] Patent Number: 5,945,636

[45] Date of Patent: Aug. 31, 1999

[54] ELECTRICAL INSULATORS WITH MECHANICAL CORE AND DIELECTRIC SHEATH

[75] Inventors: John D. Sakich, Wadsworth; Viorel Berlovan, Jr., Medina; John A. Krause, Eastlake; Randall K. Niedermier, Akron, all of Ohio

[73] Assignee: Hubbell Incorporated, Orange, Conn.

[21] Appl. No.: 08/960,095

[22] Filed: Oct. 27, 1997

Related U.S. Application Data

[63] Continuation of application No. 08/635,764, Apr. 22, 1996, abandoned.

[51] Int. Cl.[6] ..... H01B 17/16

[52] U.S. Cl. ..... 174/174; 174/209; 174/178; 174/195

[58] Field of Search ..... 174/168, 174, 174/179, 189, 194, 195, 196, 199, 201, 212, 137 A

[56] References Cited

U.S. PATENT DOCUMENTS

| | | | |
|---|---|---|---|
| 566,045 | 8/1896 | Whitaker et al. | 174/196 |
| 735,212 | 8/1903 | Converse | 174/195 |
| 2,266,400 | 12/1941 | Reed | 174/174 |
| 3,081,375 | 3/1963 | Moussou | 174/179 |
| 3,531,580 | 9/1970 | Foster | 174/152 |
| 4,177,322 | 12/1979 | Homan et al. | 428/447 |
| 4,243,628 | 1/1981 | Herold | 264/275 |
| 4,246,696 | 1/1981 | Bauer et al. | 29/887 |
| 4,373,113 | 2/1983 | Winkler et al. | 174/179 |
| 4,440,975 | 4/1984 | Kaczerginski | 174/209 |
| 4,476,081 | 10/1984 | Kaczerginski et al. | 264/262 |
| 4,701,577 | 10/1987 | Bourrieres | 174/45 R |
| 4,702,873 | 10/1987 | Kaczerginski | 264/135 |
| 4,714,800 | 12/1987 | Atkins et al. | 174/73.1 |
| 4,749,824 | 6/1988 | Orbeck | 174/179 |
| 4,940,857 | 7/1990 | Giroux | 174/174 |
| 4,973,798 | 11/1990 | Parraud et al. | 174/176 |
| 5,147,984 | 9/1992 | Mazeika et al. | 174/182 |
| 5,220,134 | 6/1993 | Novel et al. | 174/179 |
| 5,233,132 | 8/1993 | Soucille | 174/179 |
| 5,298,301 | 3/1994 | Midgley et al. | 428/34.9 |
| 5,406,033 | 4/1995 | Pazdirek | 174/176 |

FOREIGN PATENT DOCUMENTS 1932949 1/1971 Germany .

*Primary Examiner*—Hyung-Sub Sough
*Assistant Examiner*—Kamand Cuneo
*Attorney, Agent, or Firm*—Jerry M. Presson; David L. Tarnoff; Thomas P. Hilliard

[57] ABSTRACT

An electrical insulator in the form of a pintype insulator has a load sustaining mechanical core and a dielectric sheath overlying the mechanical core to protect the mechanical core from the weather. The mechanical core is constructed of a load sustaining dielectric material which is different from the dielectric material of the sheath. The mechanical core has a profiled outer surface with a top groove, two side grooves, an annular rib and an axially extending threaded bore. The dielectric sheath is applied over the mechanical core as thin as practical to minimize the amount of sheath material being used. However, the dielectrical sheath is molded on the mechanical core to form a pair of weather-sheds which can either extend radially outwardly therefrom or substantially downwardly therefrom in the form of vertical sheds.

5 Claims, 7 Drawing Sheets

ELECTRICAL INSULATORS WITH MECHANICAL CORE AND DIELECTRIC SHEATH

This is a continuation of application Ser. No. 08/635,764 filed on Apr. 22, 1996, now abandoned.

FIELD OF THE INVENTION

The present invention generally relates to electrical insulators with a mechanical core and a dielectric sheath for supporting an electrical conductor. More specifically, the present invention relates to a pintype insulator which has a profiled core with a thin dielectric sheath.

BACKGROUND OF THE INVENTION

Overhead electric power lines, wires or conductors are supported by poles or towers which may be constructed of wood, metal or other common materials. The overhead power lines are mounted on the poles or towers by insulators which are maintained upright by an upstanding pin engaging an axial blind bore of the insulator body.

These insulators were, in the past, typically constructed of a ceramic material such as porcelain, and have a variety of shapes and/or designs depending upon the necessary mechanical strength, dielectric strength and leakage distance. However, the use of porcelain for insulators has several disadvantages. For example, porcelain insulators are often very heavy to provide the necessary mechanical and electrical characteristics. Moreover, such porcelain insulators are typically expensive to install and require strong supporting structures. Additionally, porcelain insulators are brittle which makes them subject to being damaged during shipping and installation. Porcelain insulators are also susceptible to vandalism damage.

Accordingly, in recent years, newer insulators have been developed which include a fiberglass reinforced polymer core and an external protective housing forming annular flanges or webbed weathersheds. The weathershed housing or sheath is usually made of an elastomeric or an epoxy material. Elastomer or epoxy sheaths are designed to protect the fiberglass reinforced rods from weather and electrical activity. Weather and electrical activity degrade the mechanical strength of the fiberglass reinforced rods. The weathersheds on the housing intercept water flow down the insulators and increase the distance along the surface of the insulator for better electrical performance in wet or contaminated conditions.

Examples of some prior electrical devices are disclosed in U.S. Pat. Nos.: 3,531,580 to Foster; 4,243,628 to Herold; 4,440,975 to Kaczerginski, 4,476,081 to Kaczerginski et al; 4,702,873 to Kaczerginski; 4,714,800 to Atkins et al; 4,749,824 to Orbeck; 4,940,857 to Giroux; 5,220,134 to Novel et al; 5,147,984 to Mazeika et al; 5,233,132 to Soucille; 5,298,301 to Midgley et al; 5,406,033 to Pazdirek. Another example of a prior electrical device is enclosed in German Patent no. 1,932,949 to Brown, Boveri & Cie.

Generally, the core material is less costly than the sheath material. Accordingly, these newer types of insulators which utilize an elastomer or an epoxy material for its sheath can sometimes be expensive to manufacture. Accordingly, there exists a need for an electrical insulator which minimizes the amount of sheath material used in manufacturing the insulator. This invention addresses this need in the prior art as well as other needs which will become apparent to those skilled in the art from this disclosure.

SUMMARY OF THE INVENTION

An object of the present invention is to provide an electrical insulator having a solid core of rigid dielectric material capable of supporting an electrical conductor and having a sheath material overlying the mechanical core wherein the sheath material is as thin as possible.

A further object of the present invention is to provide an insulator which is simple to manufacture using relatively conventional molding or machining methods.

Still a further object of the present invention is to provide an electrical insulator which is lightweight and inexpensive to manufacture.

Another object of the present invention is to provide an electrical insulator which is easy to handle and install.

The foregoing objects are basically attained by an electrical insulator for supporting an electrical conductor, comprising a load sustaining mechanical core constructed of a dielectric material and having a top end, a bottom end with a mounting portion for coupling the mechanical core to a support member and a profiled outer surface with at least one groove for forming the electrical conductor. The insulator also includes an outer dielectric sheath overlying the profiled outer surface of the mechanical core with the electrical sheath thinly coating the groove of the mechanical core to form a conductor receiving recess overlying the groove. The dielectric sheath has a weathershed extending outwardly from the core.

Other objects, advantages and salient features of the present invention will become apparent to those skilled in the art from the following detailed description, which, taken in conjunction with the annexed drawings, discloses two preferred embodiments of the present invention.

BRIEF DESCRIPTION OF THE DRAWINGS

Referring to the drawings which form a part of this original disclosure.

DETAILED DESCRIPTION OF THE PREFERRED EMBODIMENTS

Figure 1:
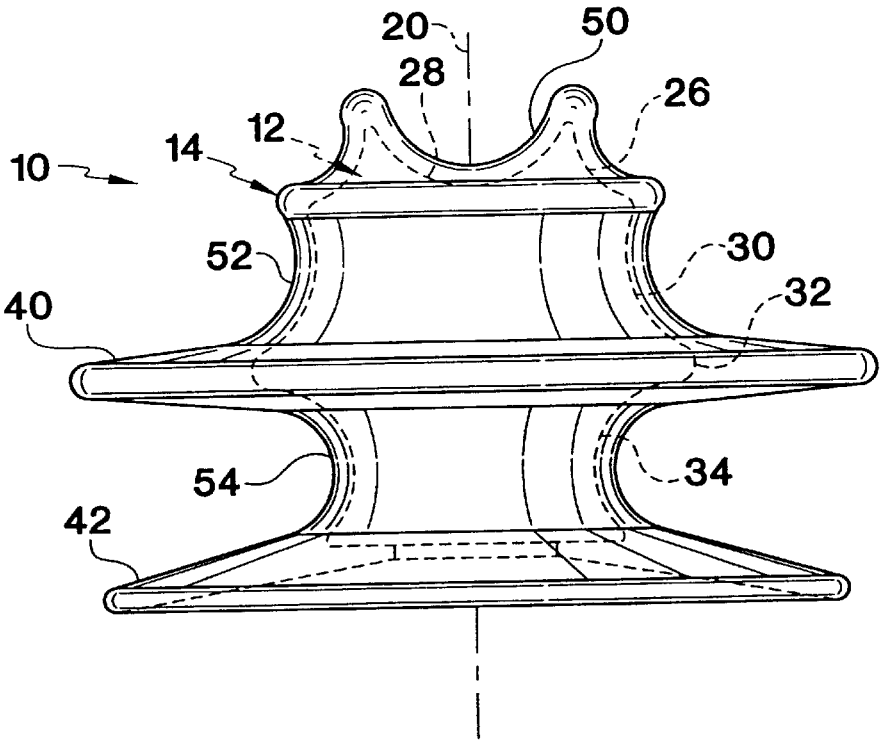
FIG. 1 is a front elevational view of a pintype electrical insulator in accordance with a first embodiment of the present invention.
Figure 2:
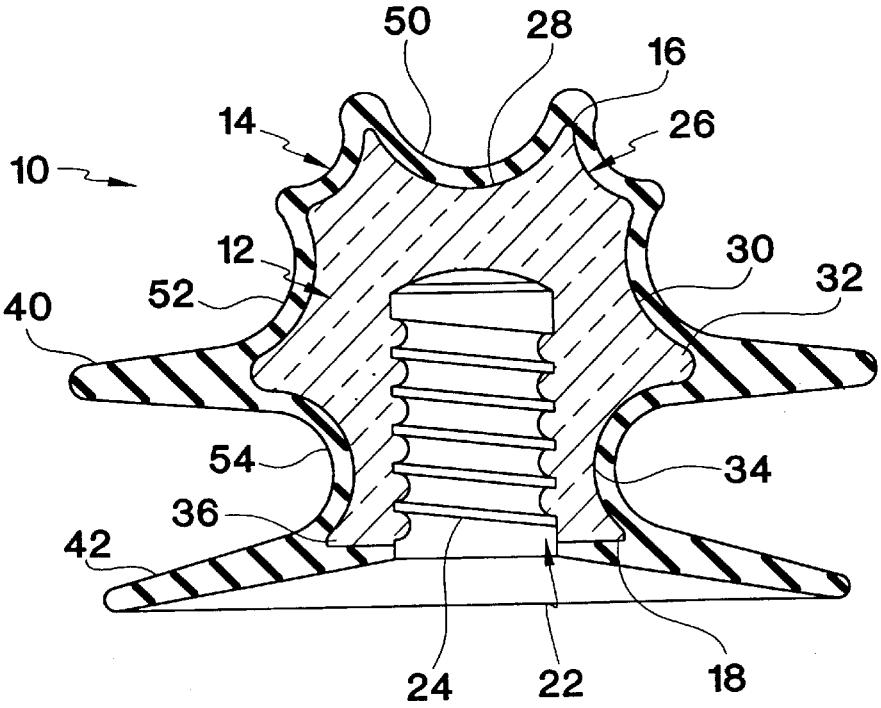
FIG. 2 is a longitudinal cross-sectional view of the pintype electrical insulator illustrated in FIG. 1.
Figure 3:
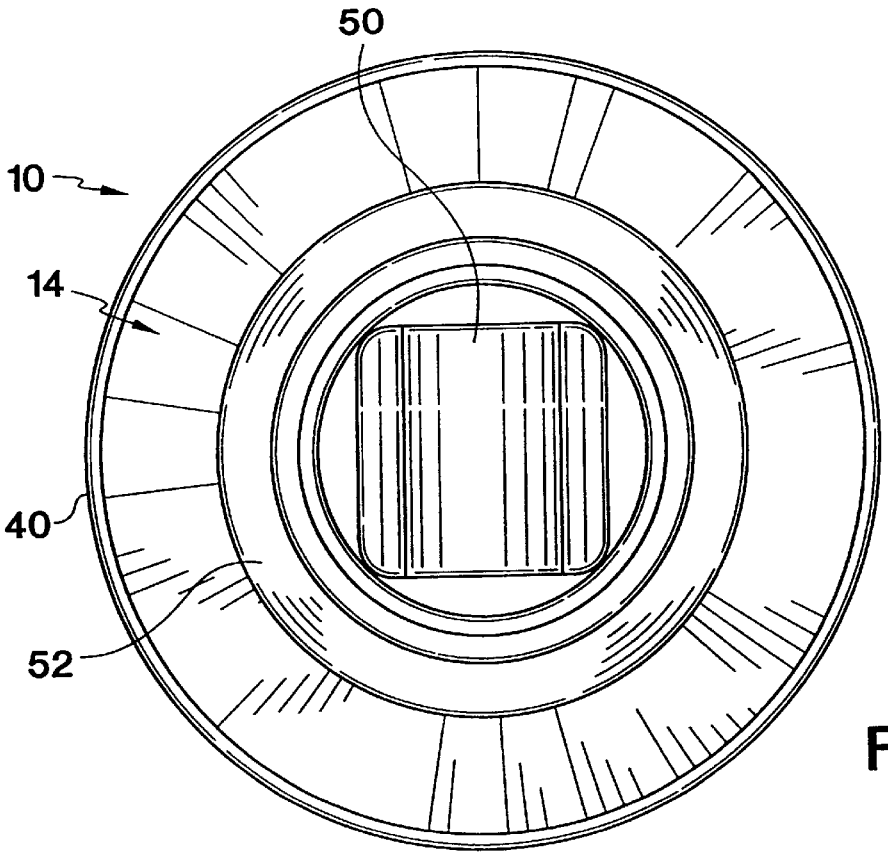
FIG. 3 is a top plan view of the pintype electrical insulator illustrated in FIGS. 1 and 2.
Figure 4:
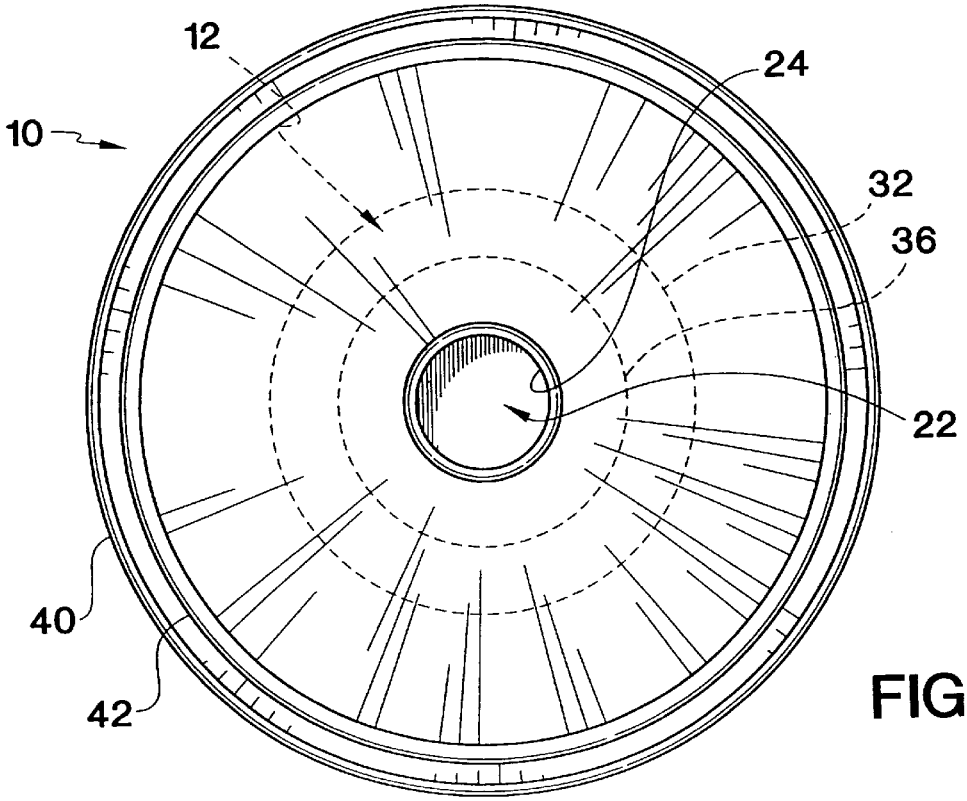
FIG. 4 is a bottom plan view of the pintype electrical insulator illustrated in FIGS. 1–3.
Figure 5:
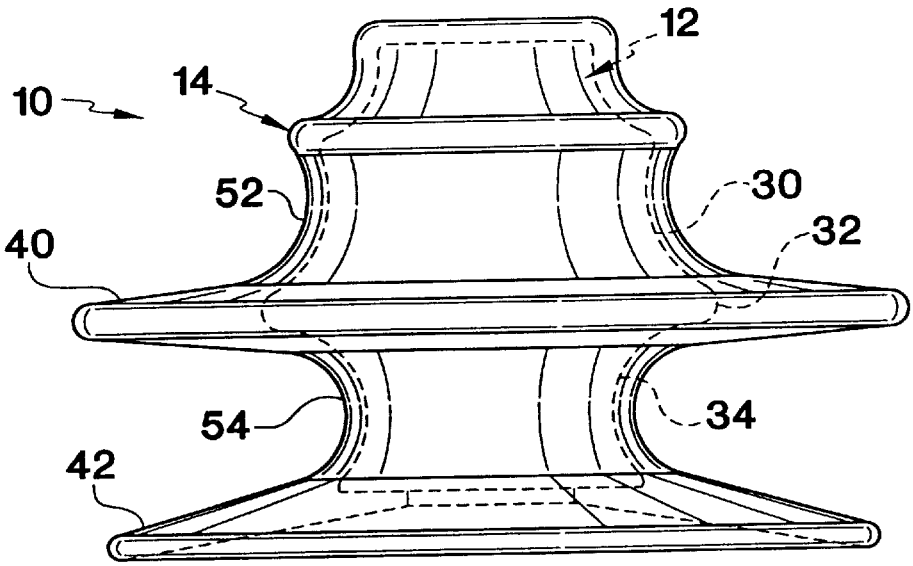
FIG. 5 is a side elevational view of the pintype electrical insulator illustrated in FIGS. 1–4.

Referring initially to FIGS. 1 and 2, an electrical insulator 10 in accordance with the present invention is illustrated. Electrical insulator 10 is a pintype insulator which is removably attached to an upstanding pin (not shown) extending from the cross-arm of a utility pole or tower (not shown).

Insulator 10 includes a load sustaining mechanical core 12 and a dielectric sheat 14 overlying mechanical core 12 to protect mechanical core 12 from weather, ultra-violet rays and electrical surface discharges. Generally, the material of the mechanical core 12 is less costly than the material of sheath 14. However, many of the materials used for mechanical core 12 are typically not for use in the outdoor environment without additional protection. Accordingly, one object of the present invention is to minimize the amount of material used in forming sheath 14. This is accomplished by constructing mechanical core 12 with a shape that keeps the material of sheath 14 as thin as possible on the mechanical core 12.

Figure 6:
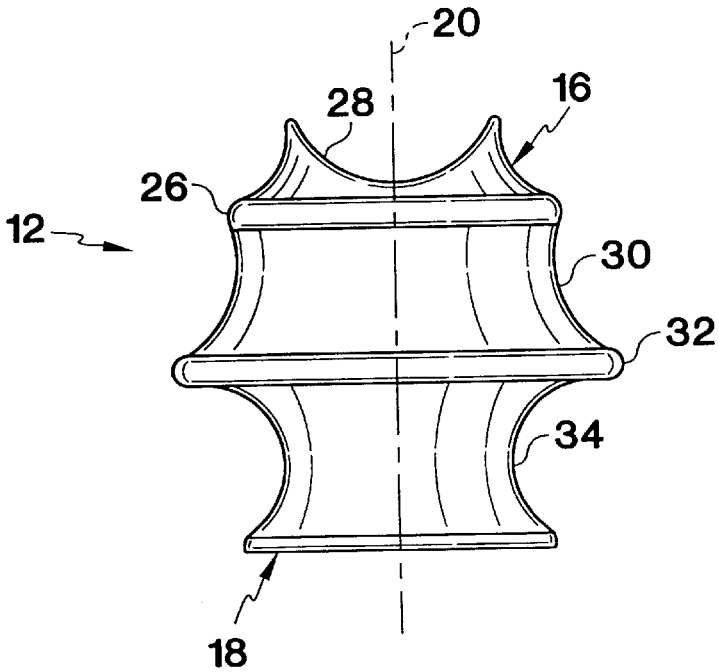
FIG. 6 is a front elevational view of the mechanical core for the pintype electrical insulator illustrated in FIGS. 1–5.
Figure 7:
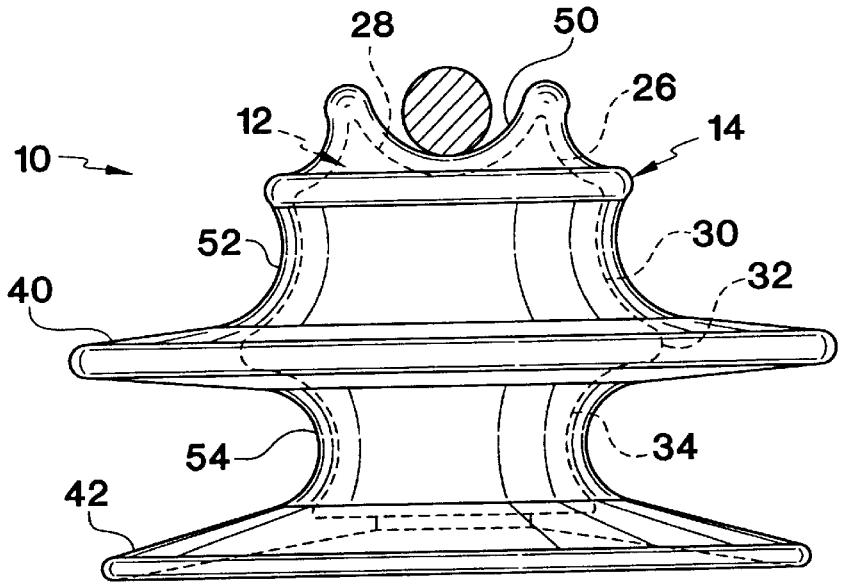
FIG. 7 is a front elevational view of the pintype electrical insulator illustrated in FIGS. 1–5; with an electrical conductor coupled in its top groove.
Figure 8:
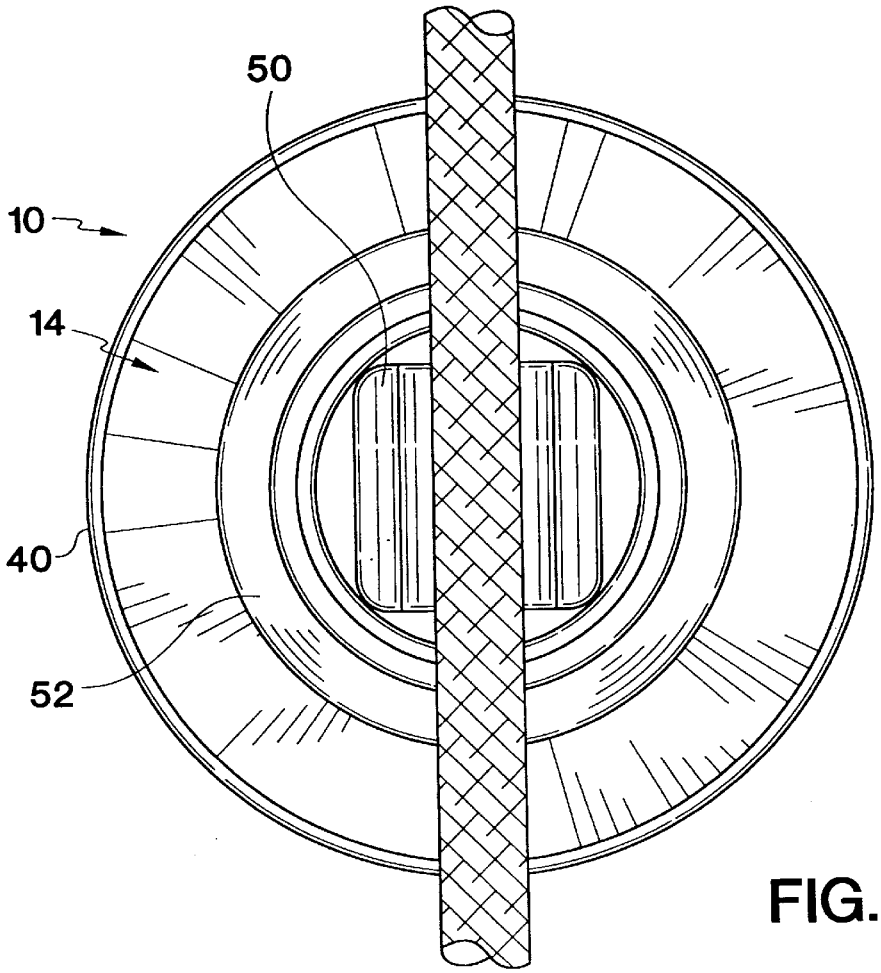
FIG. 8 is a top plan view of the pintype electrical insulator illustrated in FIGS. 1–5 and 7, with an electrical conductor coupled in its top groove.
Figure 9:
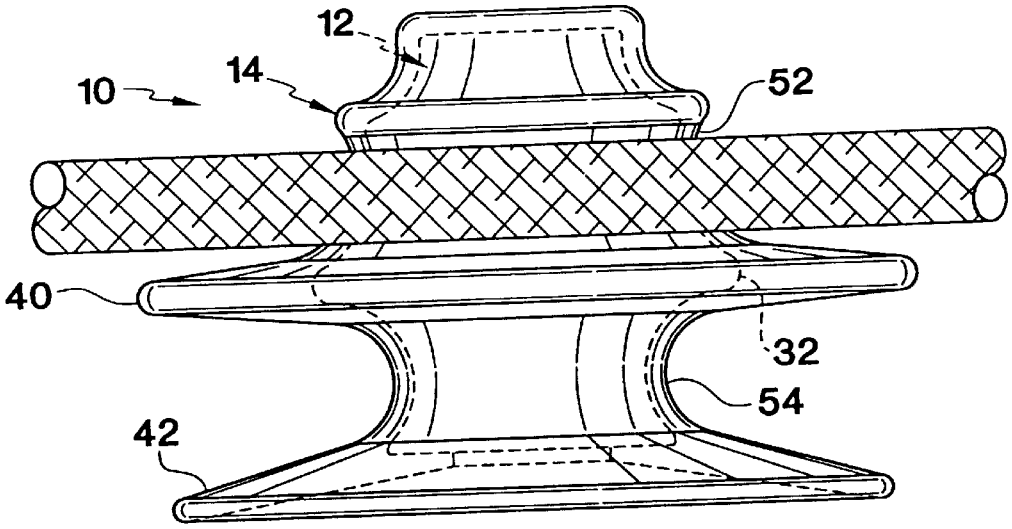
FIG. 9 is a side elevational view of the pintype electrical insulator illustrated in FIGS. 1–5, 7 and 8, with an electrical conductor coupled in its side groove.
Figure 10:
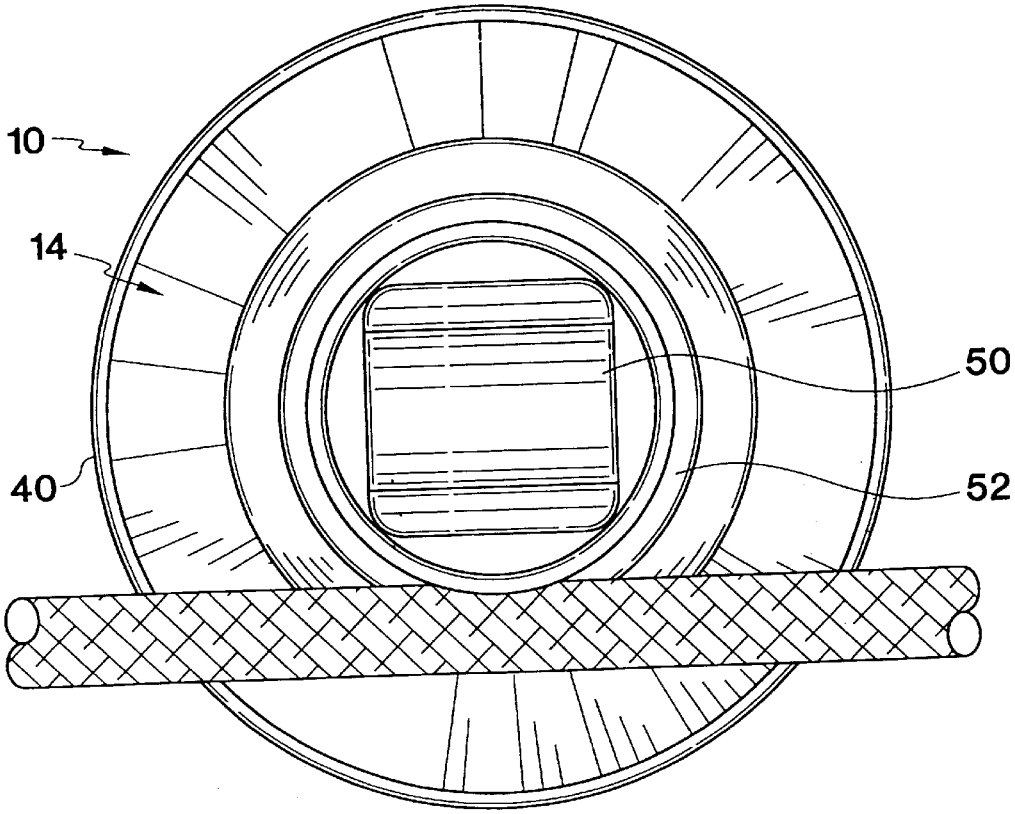
FIG. 10 is a top plan view of the pintype electrical insulator illustrated in FIGS. 1–5 and 7–9, with an electrical conductor coupled in its side groove.

As best seen in FIGS. 2 and 6, mechanical core 12 is constructed of a hard, rigid material which is capable of supporting one or more electrical conductors or power wires. The material used for mechanical core 12 can be any dielectric material, such as an epoxy or polyester, which meets the mechanical characteristic requirements of the intended use of insulator 10. Examples of some suitable materials for mechanical core 12 include various types of clays, reinforced or nonreinforced epoxies, polyesters, vinyl esters, or other plastics.

Mechanical core 12 has a top end 16 and a bottom end 18 with a longitudinal axis 20 extending therebetween. A threaded blind bore 22 is formed in bottom end 18 of mechanical core 12 for attaching insulator 10 to a pin of a utility pole or tower (not shown) in a conventional manner. The threads 24 of bore 22 are preferably tapered threads. Alternatively, the tapered threads 24 of bore 22 could be replaced so as to receive an inserted component for coupling insulator 10 to the utility pole or tower.

Mechanical core 12 has a contoured or profiled outer surface 26, which includes a top groove 28, an upper side groove 30, an annular rib 32 and a lower side groove 34. The profiled outer surface 26 of mechanical core 12 can be produced by conventional molding or machining methods which are well-known in the art. Thus, these molding and machining methods for producing mechanical core 12 will not be discussed or illustrated in detail herein. Of course, it will be apparent to those skilled in the art from this disclosure that molding methods such as compression, injection or transfer can be used to construct mechanical core 12.

Top groove 28 and upper side groove 30 are each sized to receive an electrical conductor or power wire therein once sheath 14 is applied thereto. Top groove 28 extends substantially perpendicularly to longitudinal axis 20 of insulator 10, while side groove 30 is concentrically arranged about longitudinal axis 20 of insulator 10. In other words, top groove 28 is a linear groove extending transverse to longitudinal axis 20, while side groove 30 is annular or circular groove.

Rib 32 is located between upper side groove 30 and lower side groove 34, and extends radially outwardly from the body of mechanical core 12. Rib 32 is designed to minimize the amount of material used for sheath 14 as discussed in more detail below. The diameter of rib 32 depends upon the desired shape of sheath 14 and the molding or machining method used to create mechanical core 12.

Dielectric sheath 14 covers mechanical core 12 to protect mechanical core 12 from the weather, ultra-violet rays and electrical surface discharges. Dielectric sheath 14 is preferably constructed of an elastomer or a plastic polymer such as a thermoplastic material or a thermosetting material which meets the required characteristics to protect mechanical core 12 from weather, ultra-violet rays and electrical surface discharges.

Dielectric sheath 14 is coated over mechanical core 12 using a conventional molding method such as compression, injection or transfer. Alternatively, additional methods of applying sheath 14 to mechanical core 12 includes dipping, painting or spraying mechanical core 12 with a weather resistent, ultra-violet resistant and electrical discharge resistant material such as RTV. In most applications, mechanical core 12 will be substantially completely covered by dielectric sheath 14 for sealing it from the weather. This allows use of a variety of materials for mechanical core 12, which would not usually be used in the outdoor environment. If a bond is desired between mechanical core 12 and sheath 14, it may be necessary to coat mechanical core 12 with a conventional bonding material prior to applying sheath 14.

Sheath 14 preferably follows the contour of outer surface 26 of mechanical core 12 such that sheath 14 has substantially the identical contour or profiled outer surface as outer surface 26 of mechanical core 12, except that sheath 14 is provided with a pair of annular flanges or weathersheds 40 and 42. The weathersheds 40 and 42 are designed to elongate the electrical path along the surface of insulator 10 for enhancing the electrical characteristics of insulator 10. Weathershed 40 coincides with annular rib 32 of mechanical core 12 such that annular rib 32 reduces the amount of material needed to create weathershed 40. Weather shed 40 extends beyond rib 32 at least three times more than the thickness of sheath 14 at the top of insulator 10, for example at 50. Weathershed 42, on the other hand, is located at the bottom edge 36 formed at the intersection of bottom end 18 and lower side groove 34. It will be apparent to those skilled in the art from this disclosure that bottom edge 36 can be extended to form a second annular rib which further minimizes the amount of material utilized to create weathershed 42. Weather shed 42 also extends beyond rib 36 at least three times more than the thickness of sheath 14 at the top of insulator 10.

Upon applying sheath 14 to mechanical core 12, sheath 14 forms a top conductor receiving recess 50, an upper side conductor receiving recess 52 and a lower side recess 54. Top recess 50 coincides with top groove 28 of mechanical core 12 so as to form a semi-circular channel extending transverse to longitudinal axis 20 of insulator 10. Side recesses 52 and 54 coincide with side grooves 30 and 34, respectively, with weathershed 40 being located therebetween.

In particular, recesses 52 and 54 are concentric about the longitudinal axis 20 of insulator 10 and are spaced longitudinally apart by weathershed 40. Recesses 50 and 52 are sized to receive and support an electrical conductor or power wire therein via a conventional binding or clip. Recess 54, on the other hand is designed to increase the electrical surface discharge area between weathersheds 40 and 42.

Construction and Installation

As mentioned above, insulator 10 is constructed utilizing conventional molding or machining methods. For example, in constructing insulator 10 in accordance with the present invention, mechanical core 12 can be first molded by either compression, injection or transfer molding. Then, the mechanical core 12 is covered with sheath 14 using one of the conventional molding methods such as compression, injection or transfer to apply sheath 14 to core 12 for completing construction of insulator 10.

Now, insulator 10 can be threadably coupled to a pin of a utility pole or tower (not shown) in a conventional manner. Specifically, the pin is threaded into blind bore 22 such that the threads of the pin engage threads 24 of blind bore 22 to fixedly, yet removably secure insulator 10 to the pin of the utility pole or tower. Next, an electrical conductor or power wire is selectively attached to insulator 10 via one of the recesses 50 or 52. The electrical conductor or power wire is retained in the selected recess 50 or 52 via a conventional clip or binding. Depending upon the application, an additional electrical conductor or power wire could be coupled to insulator 10.

Figure 11:
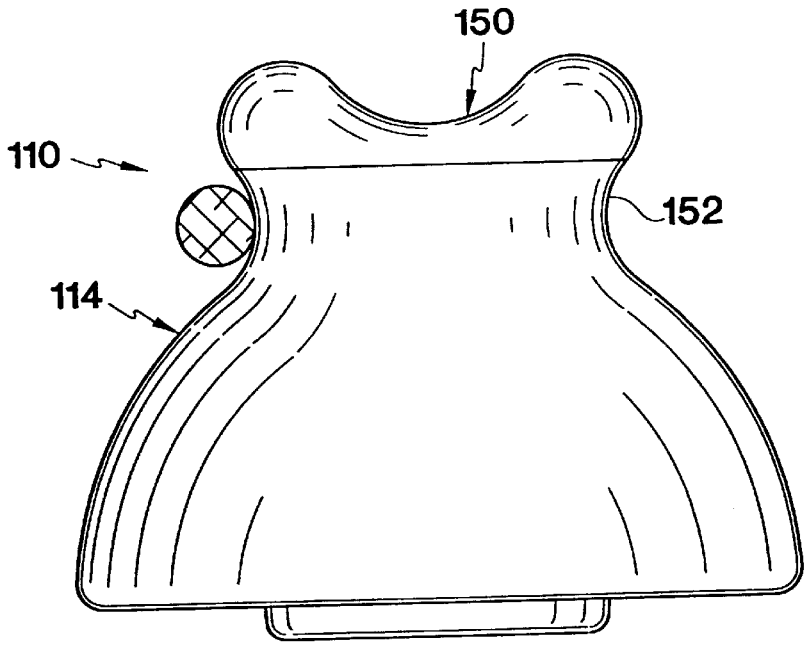
FIG. 11 is a front elevational view of a pintype electrical insulator in accordance with a second embodiment of the present invention.
Figure 12:
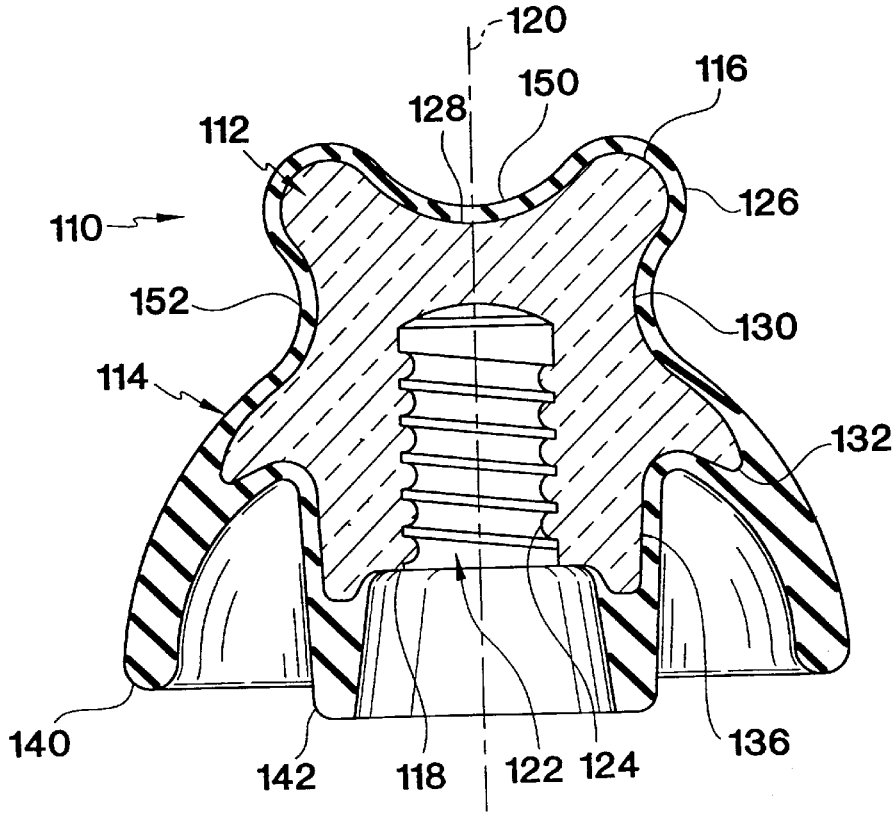
FIG. 12 is a longitudinal cross-sectional view of a pintype electrical insulator in accordance with the second embodiment of the present invention illustrated in FIG. 11.
Figure 13:
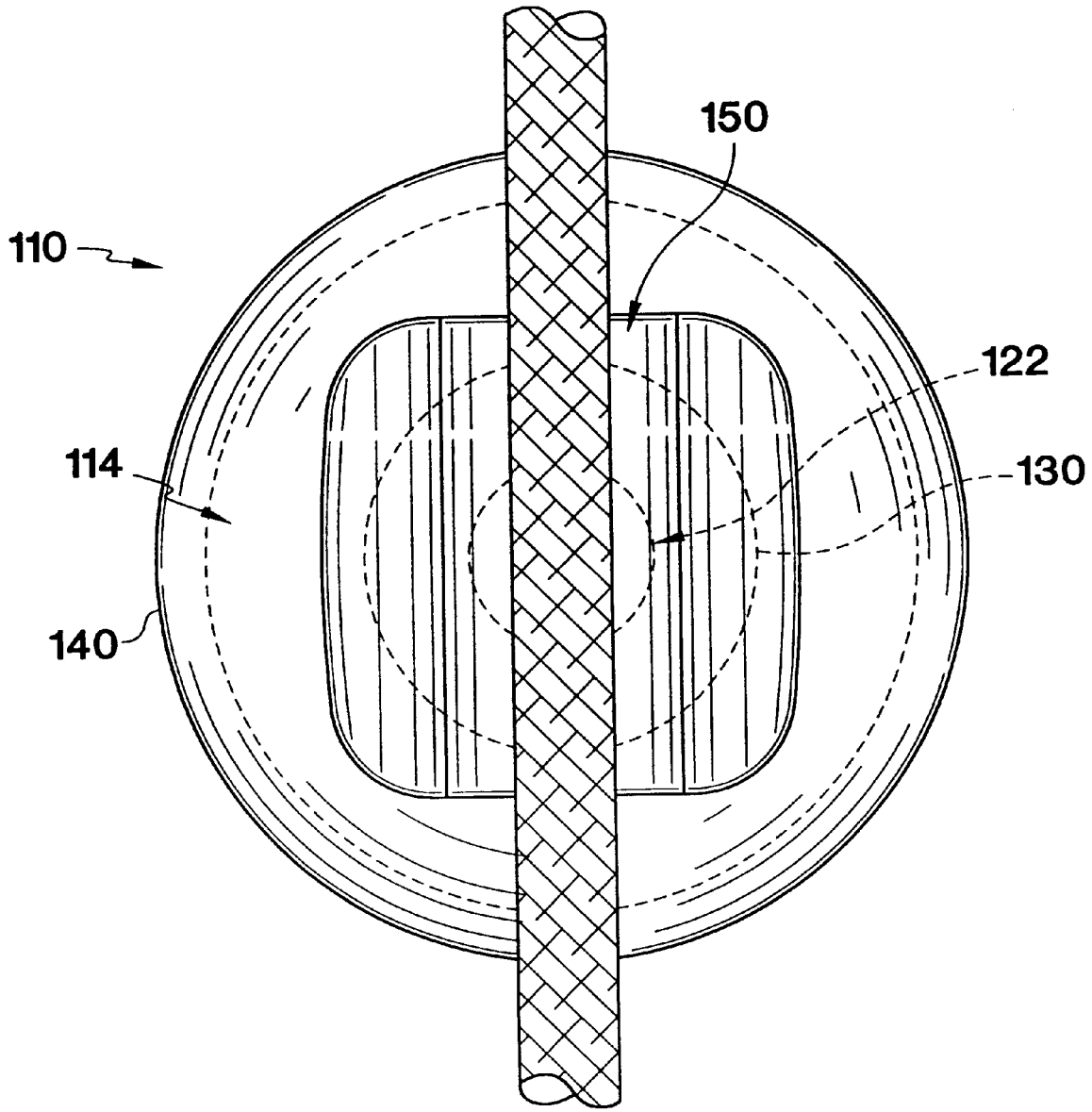
FIG. 13 is a top plan view of the pintype electrical insulator illustrated in FIGS. 11 and 12.

Alternative Embodiment of FIGS. 11–13

Referring now to FIGS. 11–13, an electrical insulator 110 in accordance with a second embodiment of the present invention is illustrated. Insulator 110 is similar in construction to insulator 10 as discussed above, except that the outer profile of its mechanical core and its dielectric sheath has been modified to produce an alternative shaped insulator. Thus, insulator 110 will not be discussed or illustrated in as much detail as the first embodiment.

Mechanical core 112 is constructed of a hard, rigid material which is capable of supporting an electrical conductor or power wire. The material used for mechanical core 112 can be any dielectric material, such as an epoxy or polyester, which meets the mechanical characteristic requirements of the intended use of insulator 110. Examples of suitable materials for mechanical core 112 include various types of clays, reinforced or nonreinforced epoxies, polyesters, vinyl esters, or other plastics.

Mechanical core 112 has a top end 116 and a bottom end 118 with a longitudinal axis 120 extending therebetween. A threaded blind bore 122 is formed in bottom end 118 of mechanical core 112 for attaching insulator 110 to a pin of a utility pole or tower (not shown) in a conventional manner. The threads 124 of bore 122 are preferably tapered threads.

Mechanical core 112 has a contoured or profiled outer surface 126, which includes a top groove 128, a side groove 130 and an annular rib 132. The profiled outer surface 126 of mechanical core 112 can be produced by conventional molding or machining methods which are well-known in the art. Thus, these molding and machining methods for producing mechanical core 112 will not be discussed or illustrated in detail herein. Of course, it will be apparent to those skilled in the art from this disclosure that molding methods such as compression, injection or transfer can be used to construct mechanical core 112.

Top groove 128 and side groove 130 are sized to receive an electrical conductor or power wire therein once sheath 114 is applied thereto. Top groove 128 extends, substantially perpendicularly to longitudinal axis 120 of insulator 110, while side groove 130 is concentrically arranged about longitudinal axis 120.

Rib 132 extends radially outwardly from the body of mechanical core 112. Rib 132 is designed to minimize the amount of material used for sheath 114 as discussed in more detail below. The diameter and shape of rib 132 depends upon the desired shape of sheath 114 and the molding or machining method used to create mechanical core 112.

Dielectric sheet 114 covers mechanical core 112 to protect mechanical core 112 from the weather, ultra-violet rays and electrical surface discharges. Dielectric sheath 114 is preferably constructed an elastomer or a plastic polymer such as a thermoplastic material or a thermosetting material which meets the required characteristics and protects the mechanical core 112 from weather, ultra-violet rays and electrical surface discharges. Dielectric sheath 114 is coated over mechanical core 112 using a conventional molding method such as compression, ejection or transfer. Alternatively, additional methods of applying the sheath 114 to mechanical core 112 include dipping, painting or spraying mechanical core 112 with a weather resistant, ultra-violet resistant and electrical discharge resistant material such as RTV.

Sheath 114 is provided with a pair of bell shaped flanges or weathersheds 140 and 142, which are designed to elongate the electrical path along the surface of insulator 110 for enhancing the electrical characteristics of insulator 110. Weathershed 140 coincides with annular rib 132 of mechanical core 112 such that annular rib 132 reduces the amount of material needed to create weathershed 140. It will be apparent to those skilled in the art that annular rib 132 can be extended further into weathershed 140 to reduce the amount of material needed to create weathershed 140. Likewise, the bottom edge 136 can be extended into weathershed 142 to form a second annular rib which further minimizes the amount of material utilized for sheath 114.

Upon applying sheath 114 to mechanical core 112, sheath 114 forms a top conductor receiving recess 150 and a side conductor receiving recess 152. Top recess 150 coincides with top groove 128 of mechanical core 112 so as to form a semi-circular channel extending transverse to longitudinal axis 120 of insulator 110. Side recess 152 coincides with side groove 130. Recesses 150 and 152 are sized to receive and support an electrical conductor or power wire therein via a conventional binding or clip.

While only two embodiments have been chosen to illustrate the present invention, it will be understood by those skilled in the art that various changes and modifications can be made herein without departing from the scope of the invention as defined in the appended claims.

What is claimed is:

1. An electrical insulator for supporting an electrical conductor, comprising:

a load sustaining mechanical core constructed of a dielectric material, and having a top end, a side, a bottom end with a mounting portion for coupling said mechanical core to a support member and a profiled core outer surface formed by said top end, said side and said bottom end, said profiled core outer surface comprising a first contour formed by said top end and said side of said mechanical core with a top groove formed therealong for supporting the electrical conductor, a second contour formed by said side of said mechanical core with a first groove formed therealong, a third contour located adjacent said second contour and formed by said side of of said mechanical core with a first radially extending rib, a fourth contour located adjacent said third contour of said mechanical core with a second groove formed therealong, and a fifth contour located adjacent said fourth contour of said mechanical core with a second radially extending rib; and an outer dielectric sheath overlying said profiled core outer surface, said dielectric sheath thinly coating said top groove, said first groove and said second groove of said mechanical core to form top, first and second recesses overlying said top groove, said first groove and said second groove, respectively, said dielectric sheath forming a first weathershed extending outwardly from said first rib of said mechanical core between said first groove and said second groove and a second weathershed extending outwardly from said second rib of said mechanical core adjacent said bottom end, said outer dielectric sheath having a profiled sheath outer surface with first and second contours overlying and being substantially identical in shape to said first and second contours of said mechanical core, respectively, a third contour formed by said first weathershed to overlie said third contour of said mechanical core such that said third contour of said profiled sheath outer surface has a different shape than said third contour of said mechanical core in that said first weathershed extends outwardly from said first rib at least three times farther than said dielectric sheath along said top, first and second grooves, a fourth contour overlying and being substantially identical in shape to said fourth contour of said mechanical core, and a fifth contour formed by said second weathershed to overlie said fifth contour of said mechanical core and having a different share than said fifth contour of said mechanical core in that said second weathershed extends outwardly from said second rib at least three times further than said dielectric sheath along said top, first and second grooves, said top groove of said mechanical core being a transverse top groove formed in said top end of said mechanical core so that the electrical conductor is adapted to be supported by said top end of said mechanical core when positioned within said first conductor receiving recess of said dielectric sheath, said first groove being a first side groove located between said top and bottom ends of said mechanical core, and said dielectric sheath thinly coats said first side groove of said mechanical core to form said first recess, said mounting portion of said mechanical core having an axially extending threaded bore.

2. An electrical insulator according to claim 1, wherein said first side groove extends annularly around said profiled outer surface of said mechanical core.

3. An electrical insulator according to claim 2, wherein said first side groove and said first conductor receiving recess are substantially circular.

4. An electrical insulator according to claim 1, wherein said first and second grooves extend annularly around said profiled outer surface of said mechanical core, and lie in parallel planes.

5. An electrical insulator according to claim 2, wherein said dielectric sheath is a material selected from a group consisting of thermosets, thermoplastics, RTV and coatings.

* * * * *